US010451337B2

(12) United States Patent
Lee et al.

(10) Patent No.: US 10,451,337 B2
(45) Date of Patent: Oct. 22, 2019

(54) THREE SECTION REFRIGERATOR WITH TWO FREEZER COMPARTMENTS

(71) Applicant: Samsung Electronics Co., Ltd, Gyeonggi-do (KR)

(72) Inventors: Hyun-Il Lee, Seoul (KR); Sang Woon Jeon, Seoul (KR); Se Lim Yoon, Gyeonggi-do (KR); Byeong Soo Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 93 days.

(21) Appl. No.: 15/349,997

(22) Filed: Nov. 11, 2016

(65) Prior Publication Data

US 2017/0138659 A1 May 18, 2017

(30) Foreign Application Priority Data

Nov. 12, 2015 (KR) ..... 10-2015-0159010

(51) Int. Cl.
*F25D 23/12* (2006.01)
*F25D 11/02* (2006.01)
(Continued)

(52) U.S. Cl.
CPC ..... *F25D 23/12* (2013.01); *F25C 5/22* (2018.01); *F25D 11/02* (2013.01); *F25D 23/028* (2013.01);
(Continued)

(58) Field of Classification Search
CPC ..... F25C 5/22; F25D 11/02; F25D 2323/021; F25D 2323/023; F25D 23/028;
(Continued)

(56) References Cited

U.S. PATENT DOCUMENTS 2,589,551 A 3/1952 Iwashita
4,098,094 A 7/1978 Linstromberg
(Continued)

FOREIGN PATENT DOCUMENTS

CN 102414525 A 4/2012
CN 102549359 A 7/2012
(Continued)

OTHER PUBLICATIONS

Machine Translation of JP 2011-064373 to Morishita et al. Mar. 31, 2011; Espacenet, description.*
(Continued)

*Primary Examiner* — Filip Zec

(57) ABSTRACT

A refrigerator comprises a body, a fresh food compartment provided in an upper portion of the body, a first freezer compartment provided in a lower portion of the body, a center compartment provided between the fresh food compartment and first freezer compartment and provided with an ice making compartment and a second freezer compartment, an upper door configured to open and close the fresh food compartment and the center compartment at a same time and a lower door configured to open and close the first freezer compartment, therefore the space utilization of the fresh food compartment may be enhanced.

14 Claims, 14 Drawing Sheets

(51) Int. Cl.
*F25D 23/02* (2006.01)
*F25D 25/02* (2006.01)
*F25C 5/20* (2018.01)

(52) U.S. Cl.
CPC ..... *F25D 23/126* (2013.01); *F25D 25/021* (2013.01); *F25D 2323/021* (2013.01); *F25D 2323/023* (2013.01); *F25D 2400/04* (2013.01); *F25D 2400/06* (2013.01); *F25D 2400/16* (2013.01)

(58) Field of Classification Search
CPC .... F25D 23/12; F25D 23/126; F25D 2400/04; F25D 2400/06; F25D 2400/16; F25D 25/021
See application file for complete search history.

(56) References Cited

U.S. PATENT DOCUMENTS

| | | | | |
|---|---|---|---|---|
| 7,386,992 | B2 * | 6/2008 | Adamski | F25D 11/02 62/344 |
| 8,074,469 | B2 * | 12/2011 | Hamel | F25D 11/022 62/441 |
| 8,806,884 | B2 | 8/2014 | Park et al. | |
| 9,046,294 | B2 * | 6/2015 | Lee | F25D 23/02 |
| 10,119,747 | B2 | 11/2018 | You et al. | |
| 2006/0130513 | A1 * | 6/2006 | Chang | F25D 11/022 62/441 |
| 2006/0201189 | A1 | 9/2006 | Adamski et al. | |
| 2009/0113923 | A1 * | 5/2009 | Young | F25D 17/065 62/441 |

FOREIGN PATENT DOCUMENTS

| | | | |
|---|---|---|---|
| CN | 104374137 | A | 2/2015 |
| EP | 0547311 | A1 | 6/1993 |
| EP | 1980809 | A2 | 2/2008 |
| EP | 2679942 | A2 | 6/2013 |
| GB | 789537 | A | 1/1958 |
| WO | 2011033804 | A1 | 3/2011 |
| WO | 2011/139116 | A2 | 11/2011 |
| WO | 2012/069439 | A2 | 5/2012 |

OTHER PUBLICATIONS

Machine Translation of EP 0547311 to Bosch, Jun. 23, 1996; Espacenet; description.*
Foreign Communication From a Related Counterpart Application, European Application No. 16198535.3, Extended European Search Report dated Mar. 10, 2017, 9 pages.
European Search Report dated Oct. 17, 2018 in connection with European Patent Application No. 18 17 7265, 9 pages.
Office Action dated Nov. 12, 2018 in connection with Chinese Patent Application No. 201610991808.X, 39 pages.
China National Intellectual Property Administration, "Notification of the Second Office Action," Application No. CN201610991808.X, dated Jun. 14, 2019, 12 pages.

* cited by examiner

THREE SECTION REFRIGERATOR WITH TWO FREEZER COMPARTMENTS

CROSS-REFERENCE TO RELATED APPLICATION(S) AND CLAIM OF PRIORITY

The present application is related to and claims the benefit of Korean Patent Application No. 10-2015-0159010, filed on Nov. 12, 2015 in the Korean Intellectual Property Office, the disclosure of which is incorporated herein by reference.

TECHNICAL FIELD

Embodiments of the present disclosure relate to a Bottom Mounted Freezer (BMF) type refrigerator in which a freezer compartment is provided in a lower portion and a fresh food compartment is provided in an upper portion.

BACKGROUND

A refrigerator is an appliance to keep food fresh by including a body having a storage compartment, and a cold air supply system to supply cold air to the storage compartment. The storage compartment includes a fresh food compartment kept at a temperature of approximately 0° C.~3° C., to store food in a refrigerated state, whereas a freezer compartment kept at a temperature of approximately −30 C~0° C., to store food in a frozen state.

The refrigerator may be classified by a position of the fresh food compartment and the freezer compartment. Particularly, the refrigerator may be classified into a bottom mounted freezer (BMF) type refrigerator in which a fresh food compartment is formed in the upper side and a freezer compartment is formed in the lower side, a top mounted freezer (TMF) type refrigerator in which a freezer compartment is formed in the upper side and a fresh food compartment is formed in the lower side, and a side by side (SBS) type refrigerator in which a freezer compartment and a fresh food compartment are formed side by side in the left and right direction. Further the refrigerator may be classified by the number of the door, and thus the refrigerator may be classified into a two door refrigerator, a three door refrigerator and a four door refrigerator.

When an ice maker and a dispenser are provided in the BMF type refrigerator, an ice making compartment may be typically provided in an upper corner of the fresh food compartment while being separated from the fresh food compartment, and then the ice maker may be disposed in the ice making compartment. Due to such the arrangement, the shape of the fresh food compartment does not have a regular hexahedron and thus the utilization of the space is reduced.

In addition, a dispenser is disposed in the door to provide ice generated in the ice maker, and an outlet of the dispenser is placed at a proper height (lower than a height of the ice maker) for the ease of use.

Therefore, it is required that a passage to guide the ice from the ice making compartment to the outlet is provided in a rear surface of the door, and thus a space in which a door guard is installed is reduced on the rear surface of the door.

SUMMARY

To address the above-discussed deficiencies, it is a primary object to provide a BMF type refrigerator having a storage space to store food and a new platform having an improved utilization.

It is another aspect of the present disclosure to provide a BMF type refrigerator having an auxiliary freezer compartment separated from a main freezer compartment and configured to be accessible by a separated door.

It is another aspect of the present disclosure to provide a BMF type refrigerator having an improved ice storage capacity.

Additional aspects of the disclosure will be set forth in part in the description which follows and, in part, will be obvious from the description, or may be learned by practice of the disclosure.

In accordance with one aspect of the present disclosure, a refrigerator comprises a body, a fresh food compartment provided in an upper portion of the body, a first freezer compartment provided in a lower portion of the body, a center compartment provided between the fresh food compartment and first freezer compartment and provided with an ice making compartment and a second freezer compartment, an upper door configured to open and close the fresh food compartment and the center compartment at the same time and a lower door configured to open and close the first freezer compartment.

The body may comprise an upper wall, a lower wall, a left wall, a right wall and a first division wall extended from the left wall of the body to the right wall of the body to divide the fresh food compartment and the center compartment.

The first division wall may be integrally formed with the upper wall, the lower wall, the left wall and the right wall.

The body may comprise an upper wall, a lower wall, a left wall, a right wall and a second division wall extended from the left wall of the body to the right wall of the body to divide the center compartment and the first freezer compartment.

The second division wall may be integrally formed with the upper wall, the lower wall, the left wall and the right wall.

The ice making compartment and the second freezer compartment may be divided from each other.

The body may comprise a middle wall configured to divide the ice making compartment and the second freezer compartment.

The ice making compartment and the second freezer compartment may be disposed side by side in the left and right direction.

The second freezer compartment and the ice making compartment may be not divided from each other.

The center compartment may further comprise a temperature convertible compartment configured to adjust a temperature thereof between a refrigerating temperature and a freezing temperature.

The refrigerator may further comprise a sealing member configured to prevent air from flowing between the fresh food compartment and the center compartment when the upper door is closed.

The refrigerator may further comprise a dispenser provided with an outlet to discharge water stored in the fresh food compartment or ice generated in the ice making compartment and a container supporter configured to support a container receiving water or ice discharged from the outlet, wherein the outlet may be provided in the upper door and the container supporter is provided in the lower door.

The refrigerator may further comprise a dispenser provided with a dispensing space configured to provide water stored in the fresh food compartment or ice generated in the ice making compartment, wherein the dispensing space may comprise a first dispensing space recessed in a lower end of a front surface of the upper door and a second dispensing space recessed in an upper end of a front surface of the lower door.

The second dispensing space may comprise an ice home bar door configured to allow a user to access to the first freezer compartment without opening the lower door.

The refrigerator may further comprise an ice home bar storage configured to be inserted into and withdrawn from the first freezer compartment when the ice home bar door is opened, and configured to receive ice discharged from the dispenser when being withdrawn from the first freezer compartment.

In accordance with another aspect of the present disclosure a refrigerator comprise an inner case, a fresh food compartment provided in the upper side and formed by the inner case, a freezer compartment provided in the lower side and formed by the inner case, an ice making compartment provided between the fresh food compartment and the freezer compartment and formed by the inner case, an ice maker disposed in the ice making compartment, an outer case coupled to the outside of the inner case, an insulation foamed between the inner case and the outer case, an upper door configured to open and close the fresh food compartment and the ice making compartment at the same time and provided with an outlet configure to discharge water stored in the fresh food compartment or ice generated by the ice maker, and a lower door configured to open and close the freezer compartment.

A first division wall configured to divide the fresh food compartment and the ice making compartment may be formed by the inner case and the insulation.

A sealing member may be provided on a rear surface of the upper door to adhere to the first division wall.

A second division wall configured to divide the ice making compartment and the freezer compartment may be formed by the inner case and the insulation.

A container supporter configured to support a container receiving water or ice discharged from the outlet may be provided in the lower door.

The refrigerator may further comprise a dispenser provided with a dispensing space configured to provide water stored in the fresh food compartment or ice generated in the ice making compartment, wherein the dispensing space may comprise a first dispensing space recessed in a lower end of a front surface of the upper door and a second dispensing space recessed in an upper end of a front surface of the lower door.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
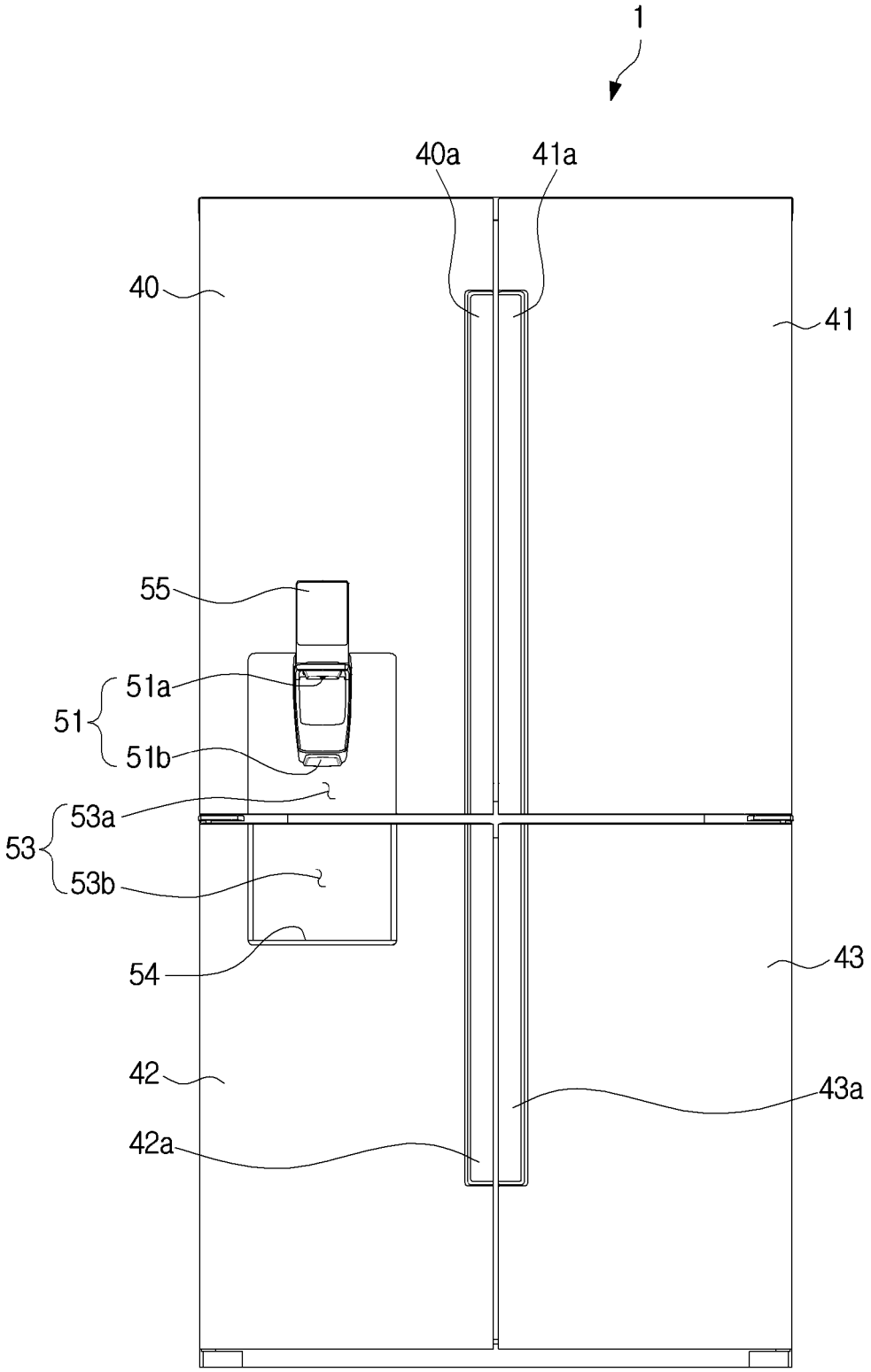
FIG. 1 illustrates a view of a front side of a refrigerator in accordance with various embodiments of the present disclosure.

FIGS. 1 through 14, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device.

The present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure.

Like reference numerals refer to like elements throughout the specification. The size and thickness of each component illustrated in the drawings are arbitrarily shown for understanding and ease of description, but the present disclosure is not limited thereto. Thicknesses of several portions and regions are enlarged for clear expressions.

Unless otherwise defined, all terms (including technical and scientific terms) used herein have the same meaning as commonly understood by one of ordinary skill in the art to which this disclosure belongs.

It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that, although the terms first, second, third, etc., may be used herein to describe various elements, but elements are not limited by these terms. These terms are only used to distinguish one element from another element.

As used herein, the singular forms "a," "an" and "the" are intended to include the plural forms as well, unless the context clearly indicates otherwise It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "front side," "rear side," "upper side," "lower side," left side," or "right side" another element, it can be directly on the other element or intervening elements may also be present.

The present disclosure will be described more fully hereinafter with reference to the accompanying drawings.

Figure 2:
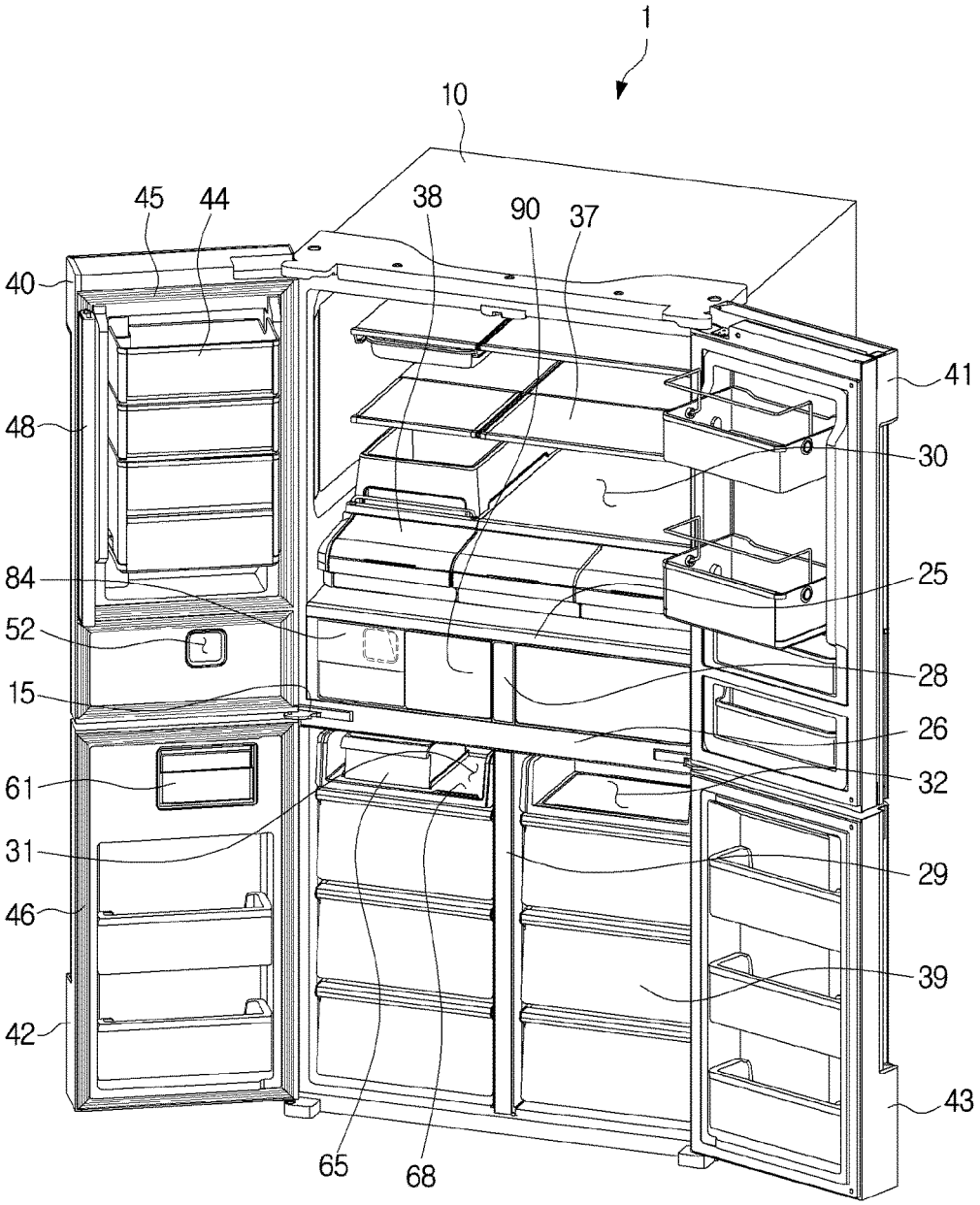
FIG. 2 illustrates a view of a state in which a door of the refrigerator of FIG. 1 is opened according to various embodiments of the present disclosure.
Figure 3:
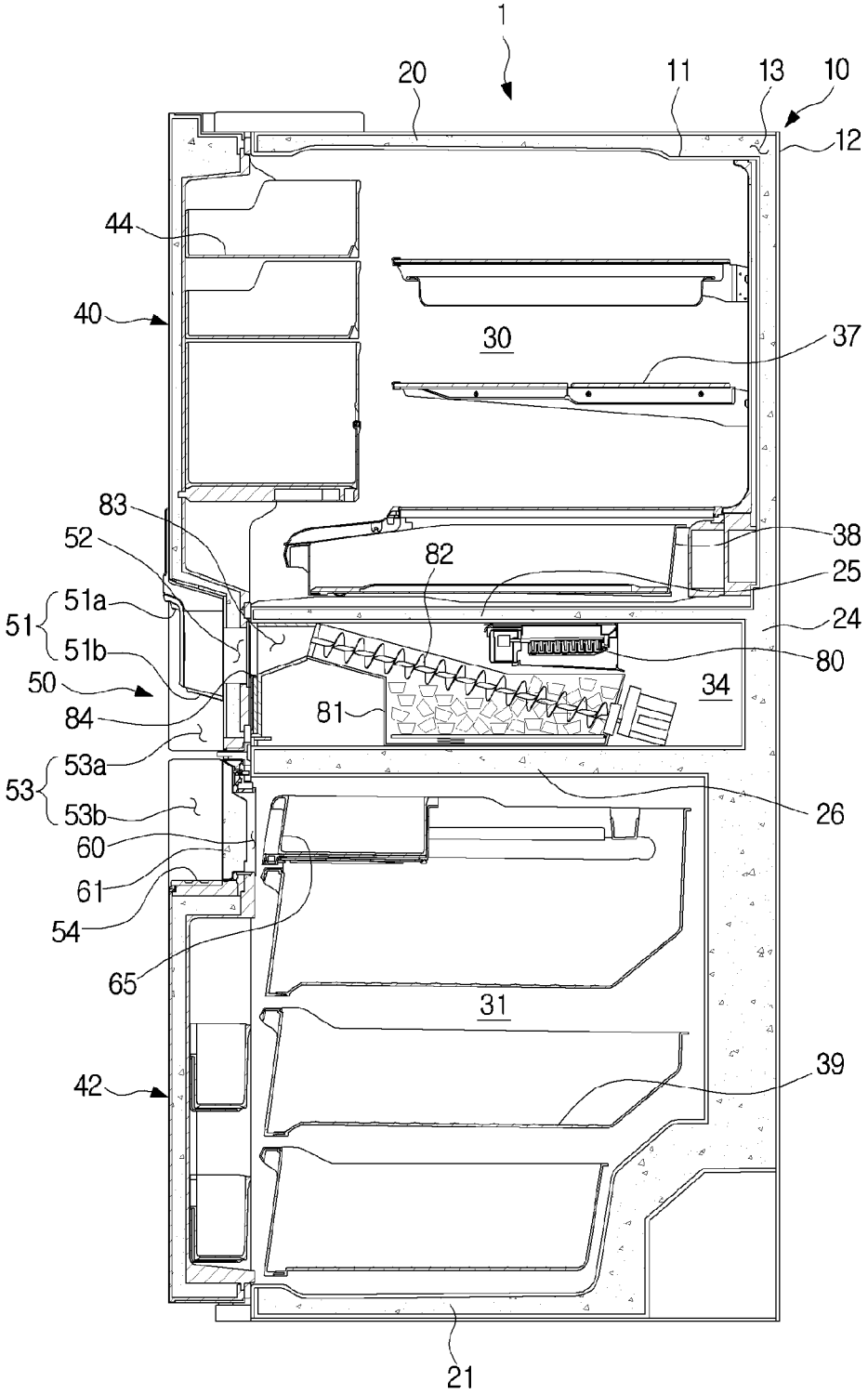
FIG. 3 illustrates a schematic, side cross sectional view of the refrigerator of FIG. 1 according to various embodiments of the present disclosure.
Figure 4:
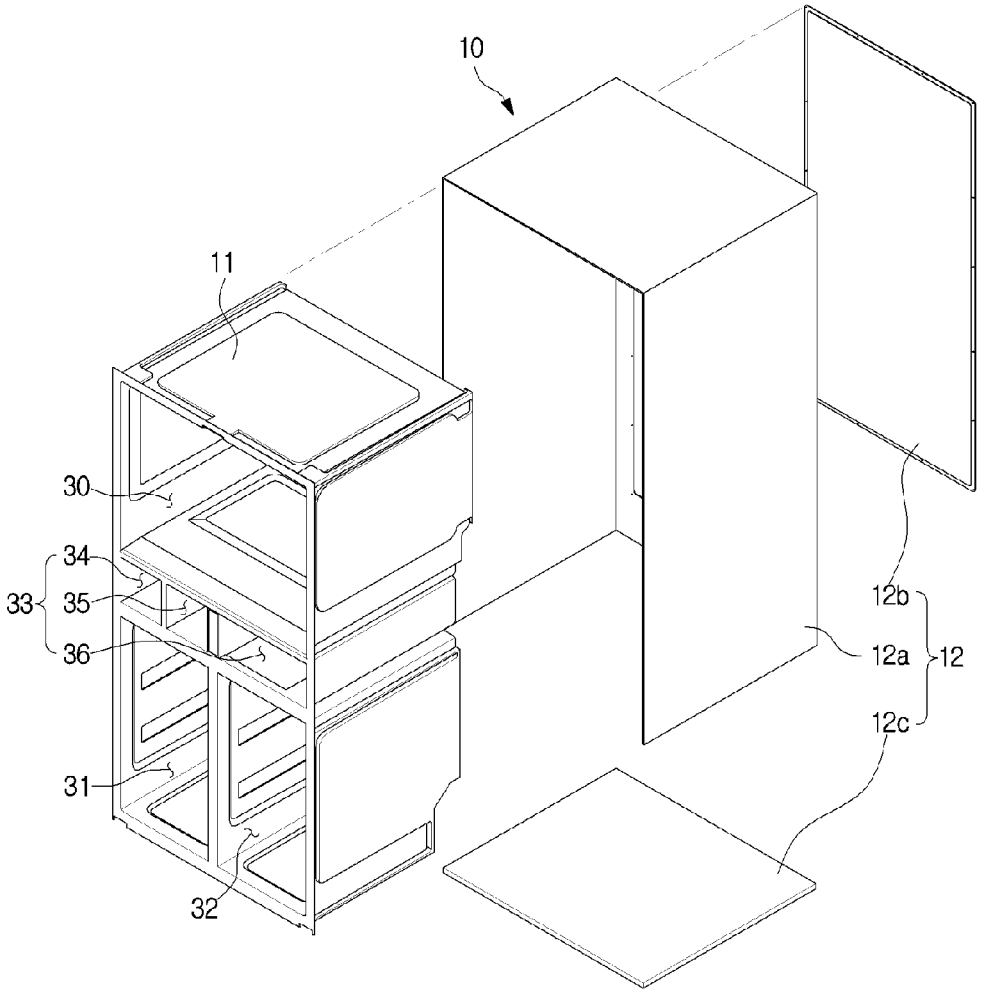
FIG. 4 illustrates an exploded view of a configuration of a body of the refrigerator of FIG. 1 according to various embodiments of the present disclosure.
Figure 5:
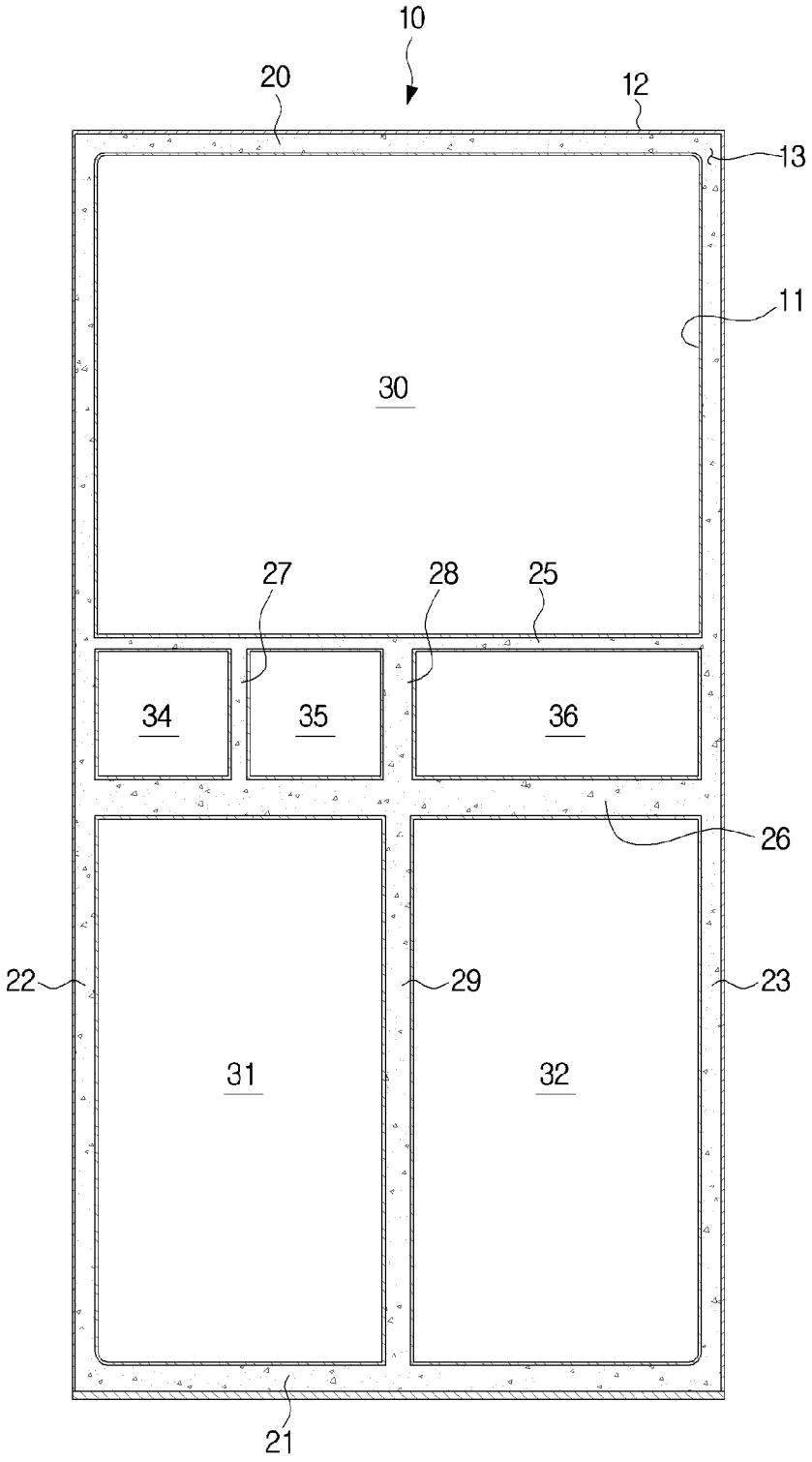
FIG. 5 illustrates a schematic, front cross sectional view of the body of the refrigerator of FIG. 1 according to various embodiments of the present disclosure.
Figure 6:
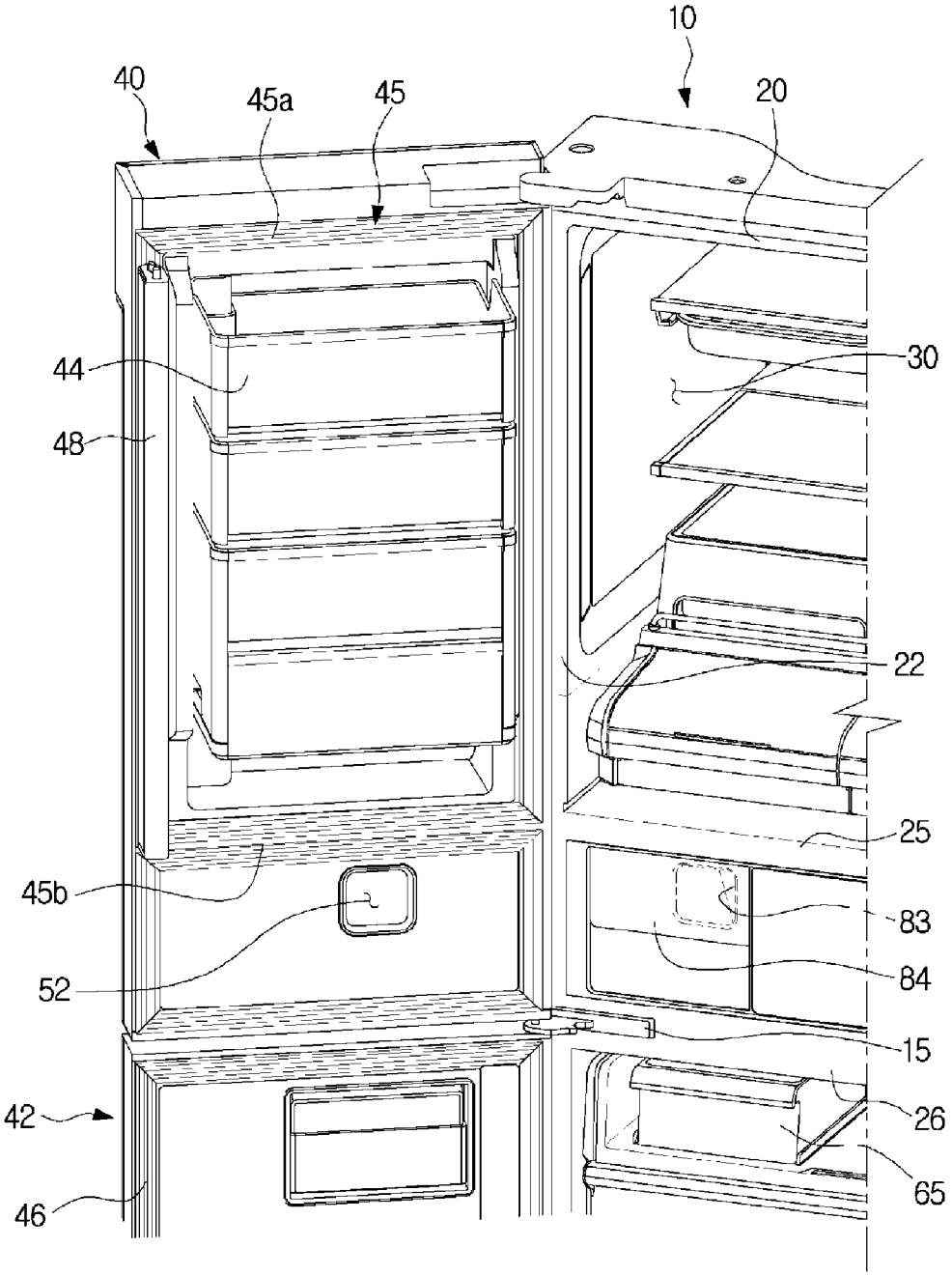
FIG. 6 illustrates a view of a sealing member of the door of the refrigerator of FIG. 1 according to various embodiments of the present disclosure.
Figure 7:
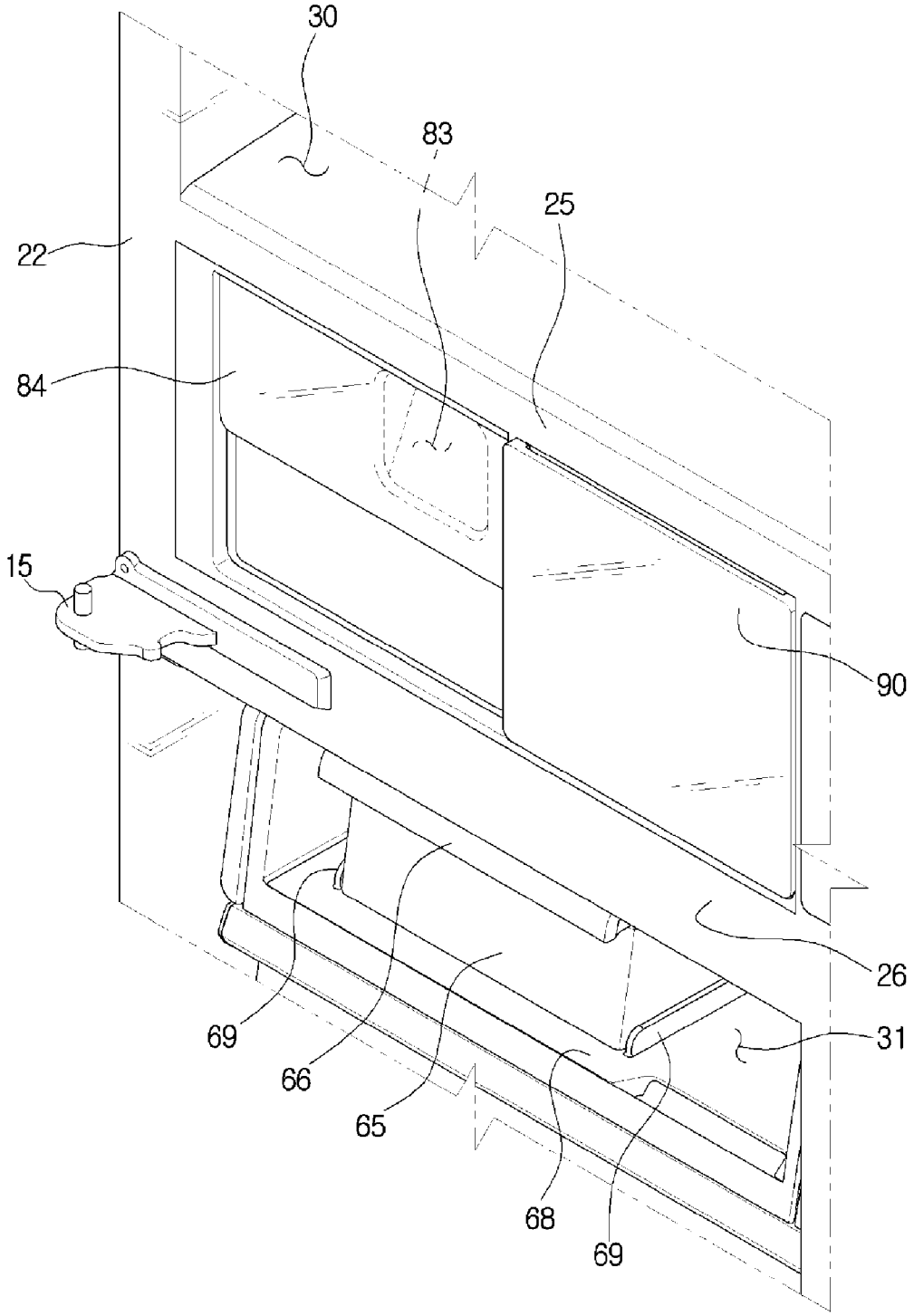
FIG. 7 illustrates a view of an ice making compartment and a second freezer compartment of the refrigerator of FIG. 1 according to various embodiments of the present disclosure.
Figure 8:
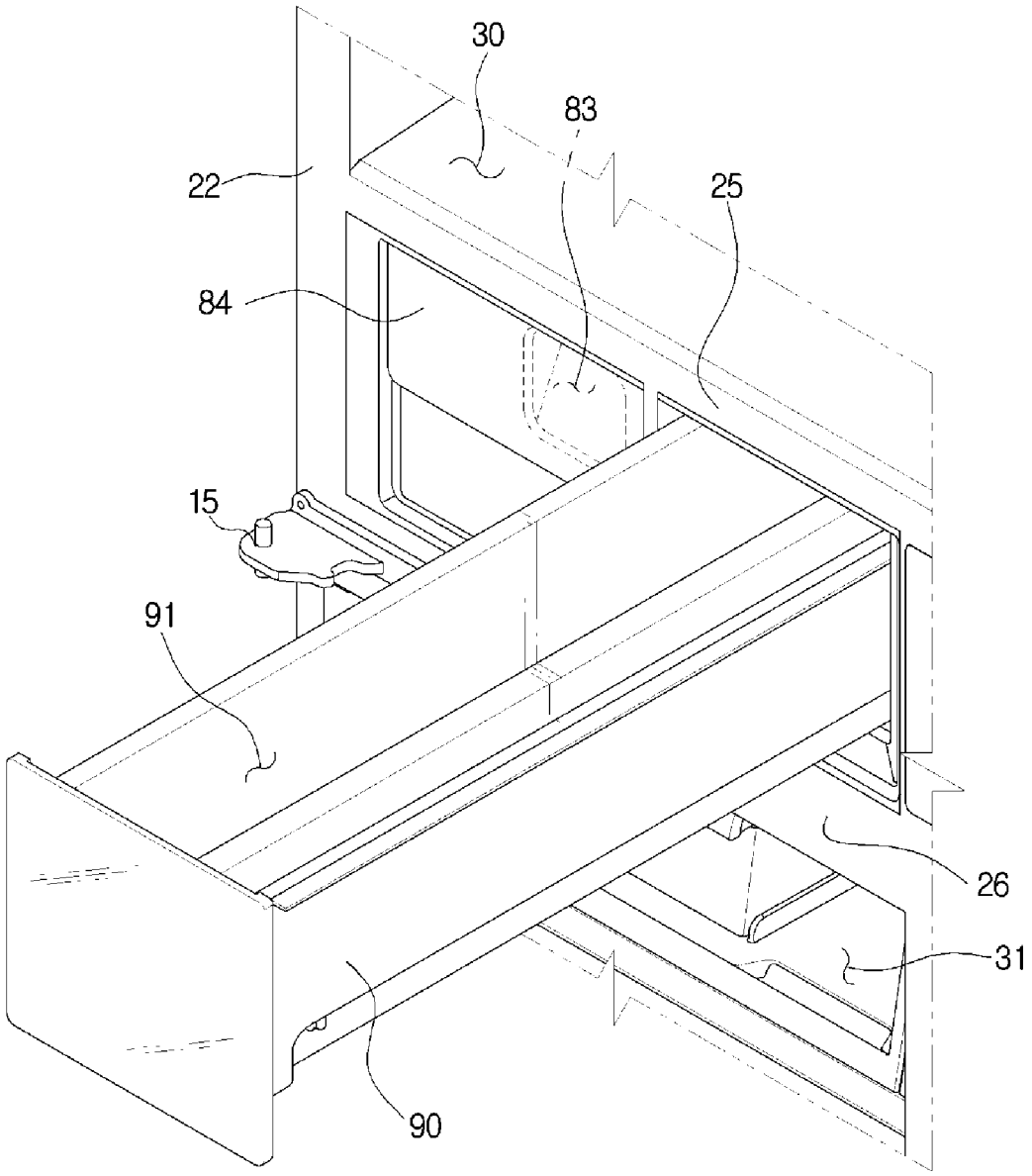
FIG. 8 illustrates a view of a state in which a storage container of the second freezer compartment of the refrigerator of FIG. 1 is withdrawn according to various embodiments of the present disclosure.
Figure 9:
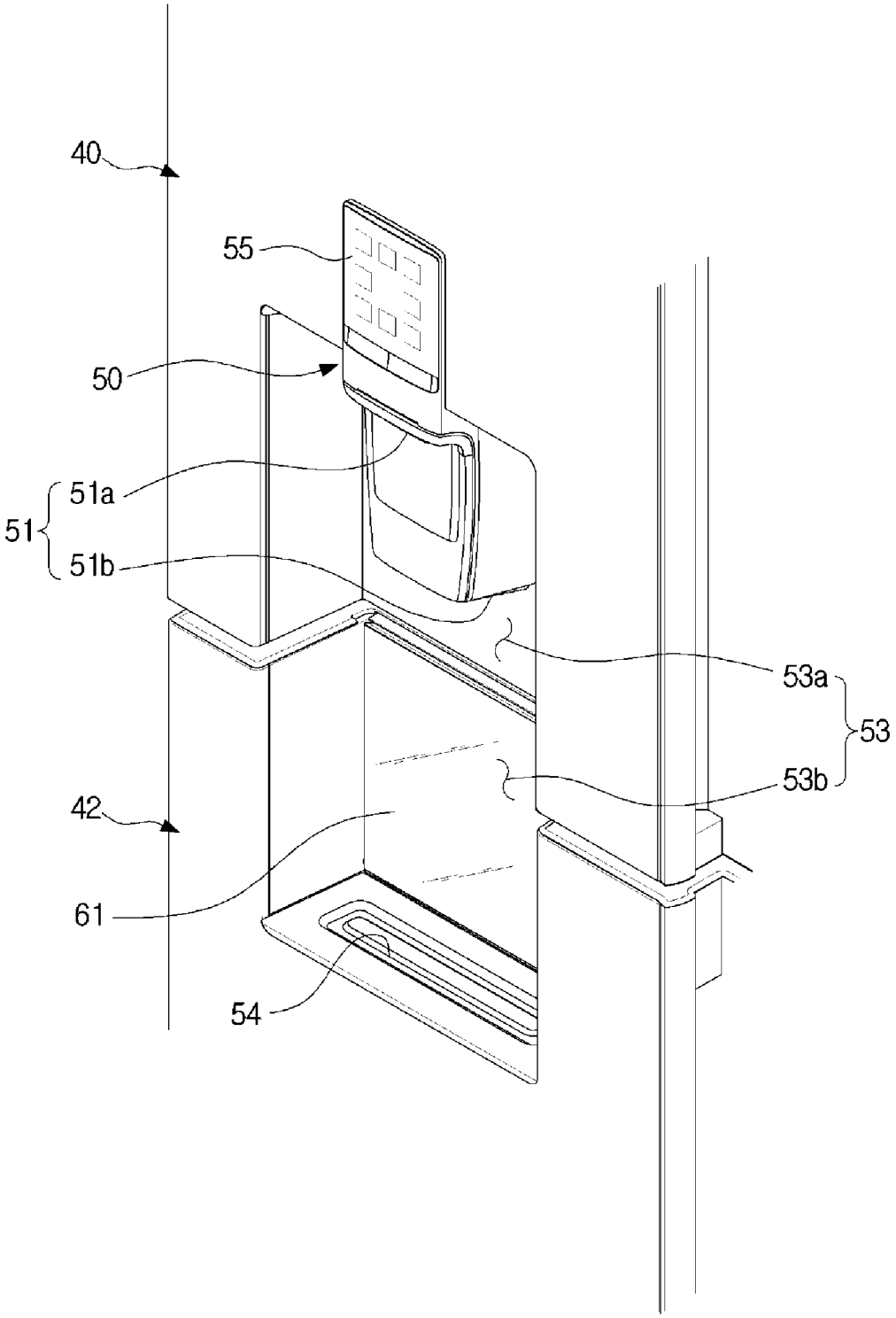
FIG. 9 illustrates a view of a dispenser of the refrigerator of FIG. 1 according to various embodiments of the present disclosure.

FIG. 1 illustrates a view of a front side of a refrigerator in accordance with various embodiments of the present disclosure. FIG. 2 illustrates a view of a state in which a door of the refrigerator of FIG. 1 is opened. FIG. 3 illustrates a schematic, side cross sectional view of the refrigerator of FIG. 1. FIG. 4 illustrates an exploded view of a configuration of a body of the refrigerator of FIG. 1. FIG. 5 illustrates a schematic, front cross sectional view of the body of the refrigerator of FIG. 1. FIG. 6 illustrates a view of a sealing member of the door of the refrigerator of FIG. 1. FIG. 7 illustrates a view of an ice making compartment and a second freezer compartment of the refrigerator of FIG. 1. FIG. 8 illustrates a view of a state in which a storage container of the second freezer compartment of the refrigerator of FIG. 1 is withdrawn. FIG. 9 illustrates a view of a dispenser of the refrigerator of FIG. 1.

A refrigerator according to certain embodiments of the present disclosure will be described with reference to FIGS. 1 to 9. The refrigerator 1 may include a body 10, storage compartments 30, 31, 32, 33, 34, 35, and 36 formed in the inside of the body 10 to store food, a cold air supply system (not shown) to supply cold air to the storage compartment 30, 31, 32, 33, 34, 35, and 36, and a door 40, 41, 42 and 43 to open and close the storage compartment 30, 31, 32, 33, 34, 35, and 36.

The storage compartment 30, 31, 32, 33, 34, 35, and 36 may include an upper compartment 30, a lower compartment 31 and 32, and a center compartment 33 formed between the upper compartment 30 and the lower compartment 31 and 32.

The upper compartment 30 may correspond to a fresh food compartment 30 configured to store food in a refrigerated state. The fresh food compartment 30 may be kept at a temperature of approximately 0° C.~5° C. to store food in a refrigerated state.

The lower compartment 31 and 32 may have a first freezer compartment 31 configured to store food in a frozen state, and a first temperature convertible compartment 32 in which a temperature thereof is regulated. The first freezer compartment 31 may be kept at a temperature of approximately −30° C.~0° C., to store food in a frozen state.

A temperature of the first temperature convertible compartment 32 may be regulated from a refrigerating temperature and a freezing temperature. The refrigerator 1 may include a temperature setting unit (not shown) to set a temperature of the first temperature convertible compartment 32 and a cold air adjusting unit (not shown) to regulate an amount of cold air supplied to the first temperature convertible compartment 32, and a temperature controller (not shown) to control the cold air adjusting unit according to a set temperature that is set by the temperature setting unit.

The temperature setting unit may be configured to allow a user to select a particular temperature range of predetermined several temperature ranges. For example, the temperature setting unit may be provided to select one temperature range of four temperature ranges; a freezing temperature range from −23° C. to −17° C., a soft freezing temperature range of −5° C., a special (chill) temperature range of −1° C., and a refrigerating temperature range of 2° C. The temperature setting unit may have a button on which the four temperature ranges are displayed. When a user presses one of the four buttons, the temperature setting unit may regulate a temperature of the first temperature convertible compartment 32 by controlling the cold air adjusting unit.

The cold air adjusting unit may include a damping device configured to regulate an amount of cold air supplied to the first temperature convertible compartment 32.

However, unlike the embodiment, a freezer compartment may be provided instead of the first temperature convertible compartment 32. Therefore, entire of the lower compartment may be configured with a freezer compartment.

The center compartment 33 may include an ice making compartment 34, a second freezer compartment 35, and a second temperature convertible compartment 36. The ice making compartment 34, the second freezer compartment 35, and the second temperature convertible compartment 36 may be disposed in parallel to each other in the left and right direction.

According to certain embodiments, the ice making compartment 34 and the second freezer compartment 35 may be divided by a first middle wall 27 described later. However, other embodiments, the first middle wall 27 may be omitted and thus the ice making compartment 34 and the second freezer compartment 35 may be not divided (refer to FIG. 14).

In the inside of the ice making compartment 34, an ice maker 80 may be disposed. The ice making compartment 34 may be kept at below zero temperature to generate and store ice. The second freezer compartment 35 may be kept at a temperature of approximately −30° C.~0° C., to store food in a frozen state, as the same as the first freezer compartment 31.

The second freezer compartment 35 may be a relatively small than the first freezer compartment 31 and thus the second freezer compartment 35 may correspond to an auxiliary freezer compartment. According to certain embodiments, the first freezer compartment 31 may be opened or closed by a lower door 42, and the second freezer compartment 35 may be opened or closed by an upper door 41. Therefore, a large size food that is needed to be inserted and withdrawn by relatively small number of times may be stored in the first freezer compartment 31 and a small size food that is needed to be inserted and withdrawn by relatively large number of times may be stored in the second freezer compartment 35. Therefore, the efficiency of the management storage may be enhanced and the unnecessary leakage of the cold air may be minimized.

A temperature of the second temperature convertible compartment 36 may be regulated from the refrigerating temperature and the freezing temperature, as the same as the first temperature convertible compartment 32.

However, unlike other embodiments, a freezer compartment may be provided instead of the second temperature convertible compartment 36. Accordingly, the center compartment 33 may be configured with the ice making compartment 34 and the freezer compartment.

The body 10 may have an approximately box shape, and a front surface thereof may be opened. The body 10 may include an inner case 11, an outer case 12 coupled to the outside of the inner case 11 and an insulation 13 provided between the inner case 11 and the outer case 12.

The inner case 11 may be formed of resin material in an injection molding method. In the inside of the inner case 11, the fresh food compartment 30, the first freezer compartment 31, the first temperature convertible compartment 32, the ice making compartment 34, the second freezer compartment 35, and the second temperature convertible compartment 36 may be formed. That is, the inner case 11 may limit a range of each storage compartment.

The outer case 12 may be formed of metal material. The outer case 12 may include a main panel 12*a* that is curved to form an upper surface and both lateral surfaces, a rear panel 12*b* and a bottom surface 12*c*.

The insulation 13 may be provided between the inner case 11 and the outer case 12. The insulation 13 may include urethane foam insulation and as needed, the insulation 13 may include a vacuum insulation panel. The urethane foam insulation may be formed such that, after the inner case 11 and the outer case 12 are coupled to each other, a space therebetween is filled with urethane foam, in which foaming agent and urethane are mixed, and then the urethane foam is foamed. The urethane foam may have a strong adhesive force so that the coupling force between the inner case 11 and the outer case 12 may be improved and it may have a sufficient intensity when the foaming is completed.

An upper wall 20, a lower wall 21, a left wall 22, a right wall 23, a rear wall 24, a first division wall 25, a second division wall 26, a first middle wall 27, a second middle wall 28, and a third middle wall 29 described later may be integrally formed with each other since the urethane foam is filled and foamed between the inner case 11 and the outer case 12.

In other words, the body 10 may have the upper wall 20, the lower wall 21, the left wall 22, the right wall 23, the rear wall 24, the first division wall 25, the second division wall 26, the first middle wall 27, the second middle wall 28, and the third middle wall 29.

The first division wall 25 may divide an inner space of the body 10 into an upper portion and a lower portion. That is, the first division wall 25 may divide an inner space of the body 10 into the fresh food compartment 30 and the center compartment 33. The first division wall 25 may be approximately horizontally extended from the left wall 22 to the right wall 23, and may include the inner case 11 and the insulation 13.

The second division wall 26 may divide an inner space of the body 10 into an upper portion and a lower portion. That is, the second division wall 26 may divide an inner space of the body 10 into the center compartment 33 and the lower compartment 31 and 32. The second division wall 26 may be approximately horizontally extended from the left wall 22 to the right wall 23, and may include the inner case 11 and the insulation 13.

The first middle wall 27 may divide the center compartment 33 into the left side and the right side. That is, the first middle wall 27 may divide the center compartment 33 into the ice making compartment 34 and the second freezer compartment 35. The first middle wall 27 may be approximately vertically extended from the first division wall 25 to the second division wall 26, and may include the inner case 11 and the insulation 13.

The second middle wall 28 may divide the center compartment 33 into the left side and the right side. That is, the second middle wall 28 may divide the center compartment 33 into the second freezer compartment 35 and the second temperature convertible compartment 36. The second middle wall 28 may be approximately vertically extended from the first division wall 25 to the second division wall 26, and may include the inner case 11 and the insulation 13.

The third middle wall 29 may divide the lower compartment 31 and 32 into the left side and the right side. That is, the third middle wall 29 may divide the lower compartment 31 and 32 into the first freezer compartment 31 and the first temperature convertible compartment 32. The third middle wall 29 may be approximately vertically extended from the second division wall 26 to the lower wall 21, and may include the inner case 11 and the insulation 13.

In the each storage compartment, a shelf 37 on which food are placed, an airtight container 38 to airtightly store food and a drawer 39 slidable back and forth may be provided.

In the first freezer compartment 31, an ice home bar storage 65 may be provided. The ice home bar storage 65 may receive ice discharged through a dispenser 50 described later and store the ice. The ice storage capacity may be increased by the ice home bar storage 65. A detail description of the ice home bar storage 65 will be described later.

In the second freezer compartment 35, a mini freezer box 90 having a storage space 91 (refer to FIG. 8) to store food may be provided. The mini freezer box 90 may be configured to allow food to be easily stored and withdrawn in the second freezer compartment 35 having a relatively narrow space, and the mini freezer box 90 may be inserted into or withdrawn from the inside of the second freezer compartment 35 in a sliding manner.

In the ice making compartment 34, an ice maker 80 to generate ice and an ice bucket 81 to store the ice generated by the ice maker 80 may be provided. The ice maker 80 may include an ice tray to store water, and an ejector to separate the ice generated in the ice tray.

The ice maker 80 may generate ice in an indirect cooling method in which water is frozen by cold air of the ice making compartment 34 or in a direct cooling method in which water is frozen by directly receiving cooling energy by a refrigerant pipe that makes contact with the ice tray.

In the ice bucket 81, a transfer device to deliver ice stored in the ice bucket 81 may be provided. The transfer device may include an auger 82 having a spiral shape and a driving device to drive the auger 82. When the auger 82 is rotated, the ice stored in the ice bucket 81 may be moved forward.

An ice outlet 83 may be formed in the front side of the ice bucket 81 to discharge ice to the outside, and the ice discharged via the ice outlet 83 may be guided to a chute 52 of the dispenser 50.

The ice bucket 81 may include an inclined part inclined upwardly to the front side, and the auger 82 may be disposed such that a rotational axis thereof is inclined. Due to the structure, the ice outlet 83 may be placed higher than a bottom surface of the ice bucket 81. That is, the ice stored in the ice bucket 81 may be moved slightly upward and then fallen when discharged.

A shutter 84 may be provided in the ice outlet 83 to prevent cold air from being leaked via the ice outlet 83 when the door 40 is opened. The shutter 84 may be operated in conjunction with a motion of opening and closing of the door 40. For example, the shutter 84 may be movable upward and downward, and thus when the door 40 is closed, the shutter 84 may be moved downward to open the ice outlet 83 and when the door 40 is opened, the shutter 84 may be moved upward to close the ice outlet 83.

The door 40, 41, 42 and 43 to open and close the storage compartment 30, 31, 32, 33, 34, 35, and 36 may include a first upper door 40, a second upper door 41, a first lower door 42, a second lower door 43, and a fourth door of the second lower door 43. Each of the door 40, 41, 42 and 43 may be rotatably coupled to the body 10.

The first upper door 40 and the second upper door 41 may be rotatably coupled to the body 10 by an upper hinge and a middle hinge 15, respectively. The middle hinge 15 may be coupled to the second division wall 26 to support the first upper door 40 and the second upper door 41. The first upper door 40 and the second upper door 41 may be opened or closed while being rotated in a different direction in which directions are opposite to each other. On the inside of the first upper door 40 and the second upper door 41, a handle 40*a* and 41*a* may be provided.

The first upper door 40 and the second upper door 41 may open or close the fresh food compartment 30 and the center compartment 33 at the same time. Particularly, the first upper door 40 may open or close a part of the fresh food compartment 30, the ice making compartment 34, and the second freezer compartment 35 and the second upper door 41 may open or close the rest of the fresh food compartment 30 and the second temperature convertible compartment 36.

Therefore, when opening the first upper door 40, it may be possible to access the fresh food compartment 30 and the second freezer compartment 35 at the same time. When opening the second upper door 41, it may be possible to access the fresh food compartment 30 and the second temperature convertible compartment 36 at the same time.

A filler 48 may be provided in the first upper door 40 to prevent cold air from being leaked between the first upper door 40 and the second upper door 41 in a state in which the first upper door 40 and the second upper door 41 are closed.

A sealing member 45 may be provided on a rear surface of the upper door 40 and 41 to prevent cold air from being leaked between the upper door 40 and 41 and the body 10 in a state in which of the upper door 40 and 41 are closed.

The sealing member 45 may be formed of rubber material. The sealing member 45 may include an outer sealing part 45*a* formed along an edge of the rear surface of the upper door 40 and 41 and a center sealing part 45*b* formed in the center of the outer sealing part 45*a* to prevent air from being moved between the fresh food compartment 30 and the center compartment 33.

The outer sealing unit 45*a* may be formed in a closed-loop shape having an approximately square shape. When the upper door 40 and 41 are closed, the outer sealing unit 45*a* may adhere to the upper wall 20, the left wall 22, the second division wall 26 and the right wall 23.

When the upper door 40 and 41 are closed, the center sealing unit 45*b* may adhere to the first division wall 25 of the body 10.

The first lower door 42 and the second lower door 43 may be rotatably coupled to the body 10 by the middle hinge 15 and a lower hinge, respectively. The first lower door 42 and the second lower door 43 may be opened or closed while being rotated in a different direction in which directions are opposite to each other. On the inside of the first lower door 42 and the second lower door 43, a handle 42*a* and 43*a* may be provided.

The first lower door 42 may open and close the first freezer compartment 31. The second lower door 43 may open and close the first temperature convertible compartment 32.

The refrigerator 1 may include the dispenser 50 configured to provide water stored in the fresh food compartment 30 or ice stored in the ice bucket 81 of the ice making compartment 34. A user may be supplied with the water or the ice by the dispenser 50 without opening the upper door 40.

The dispenser 50 may include an outlet 51 having a water outlet 51*a* to discharge water and an ice outlet 51*b* to discharge ice, a dispensing space 53 to accommodate a container in which the water or the ice is store, a container supporter 54 to support the container in which the water or the ice is store, a chute 52 to guide the ice discharged from the ice outlet 83 of the ice bucket 81 to the ice outlet 51*b*, and an operation panel unit 55 (refer to FIG. 9) to receive an operation command and to display an operation status.

The outlet 51 may be provided in the upper door 40. The ice outlet 51*b* may be approximately disposed on the same height as the height of a bottom surface of the ice bucket 81 or on a higher than the bottom surface of the ice bucket 81. Therefore, a length of the chute 52 may be reduced in comparison with a length of a chute in a conventional manner, and thus on the rear surface of the door 40, a food storage space may be increased.

The dispensing space 53 may be formed with a part of the upper door 40 and a part of the lower door 42. That is, the dispensing space 53 may include a first dispensing space 53*a* recessed in a lower end of the front surface of the upper door 40 and a second dispensing space 53*b* recessed in an upper end of the front surface of the lower door 42.

The container supporter 54 configured to support the container may be provided in a lower end of the second dispensing space 53*b*. That is, the container supporter 54 may be provided in the lower door 42.

By using the structure, the user may take water or ice with more ease due to the position and the size of the available container may be enlarged.

An ice home bar door 61 may be provided in the second dispensing space 53*b* to access the first freezer compartment 31 without opening the lower door 42. An ice home bar opening 60 (refer to FIG. 10) may be formed in the lower door 42 and the ice home bar door 61 may be configured to open and close the ice home bar opening 60.

The ice home bar door 61 may be rotatably coupled to the lower door 42 to allow to be tilted in upward and downward. When the ice home bar door 61 is opened, the ice home bar storage 65 may be inserted into or withdrawn from the inside of the first freezer compartment 31 via the ice home bar opening 60. On the front surface of the ice home bar storage 65, a handle 66 may be provided. The user may insert and withdraw the ice home bar storage 65 by holding the handle 66.

In the first freezer compartment 31, a supporting shelf 68 to support the ice home bar storage 65, a guide unit 69 (refer to FIG. 7) to guide a motion of insertion and withdrawal of the ice home bar storage 65, and a stopper unit 70 (refer to FIG. 10) to limit a distance of the insertion of the ice home bar storage 65 may be provided.

The guide unit 69 may be protruded to an upper side of the supporting shelf 68 to be elongated in the front and rear side. The stopper unit 70 may be bent from a rear end of the supporting shelf 68 to the upper side. An operation of the ice home bar storage 65 will be described later.

The cold air supply system may generate cold air using a refrigeration cycle. The cold air supply system may include a compressor (not shown), a condenser (not shown), an expansion device (not shown), an evaporator (not shown), a blowing fan (not shown) and at least one refrigerant circuit in which refrigerant is circulated.

There may be no limitation in the number of the compressor, the condenser, the expansion device, the evaporator and the blowing fan, and the shape of the refrigerant circuit.

For example, the cold air supply system may have a plurality of refrigerant circuit; a first refrigerant circuit and a second refrigerant circuit. In the first refrigerant circuit, a first compressor, a first evaporator, and a first blowing fan may be provided. In the second refrigerant circuit, a second compressor, a second evaporator, a third evaporator, a second blowing fan and a third blowing fan may be provided.

The first blowing fan may supply cold air generated in the first evaporator to the fresh food compartment 30. The second blowing fan may supply cold air generated in the second evaporator to the first freezer compartment 31, the ice making compartment 34, and the second freezer compartment 35. The third blowing fan may supply cold air generated in the third evaporator to the first temperature convertible compartment 32 and the second temperature convertible compartment 36.

As a result, the cold air supply system may independently supply cold air to three parts and thus the fresh food compartment 30 corresponding to the upper compartment; the first freezer compartment 31, the ice making compartment 34, and the second freezer compartment 35 corresponding to the left storage of the center and lower compartment; and the first temperature convertible compartment 32 and the second temperature convertible compartment 36 corresponding to the right storage of the center and lower compartment may be independently cooled.

However, as mentioned above, the cold air supply system may is an example, but is not limited thereto.

Figure 10:
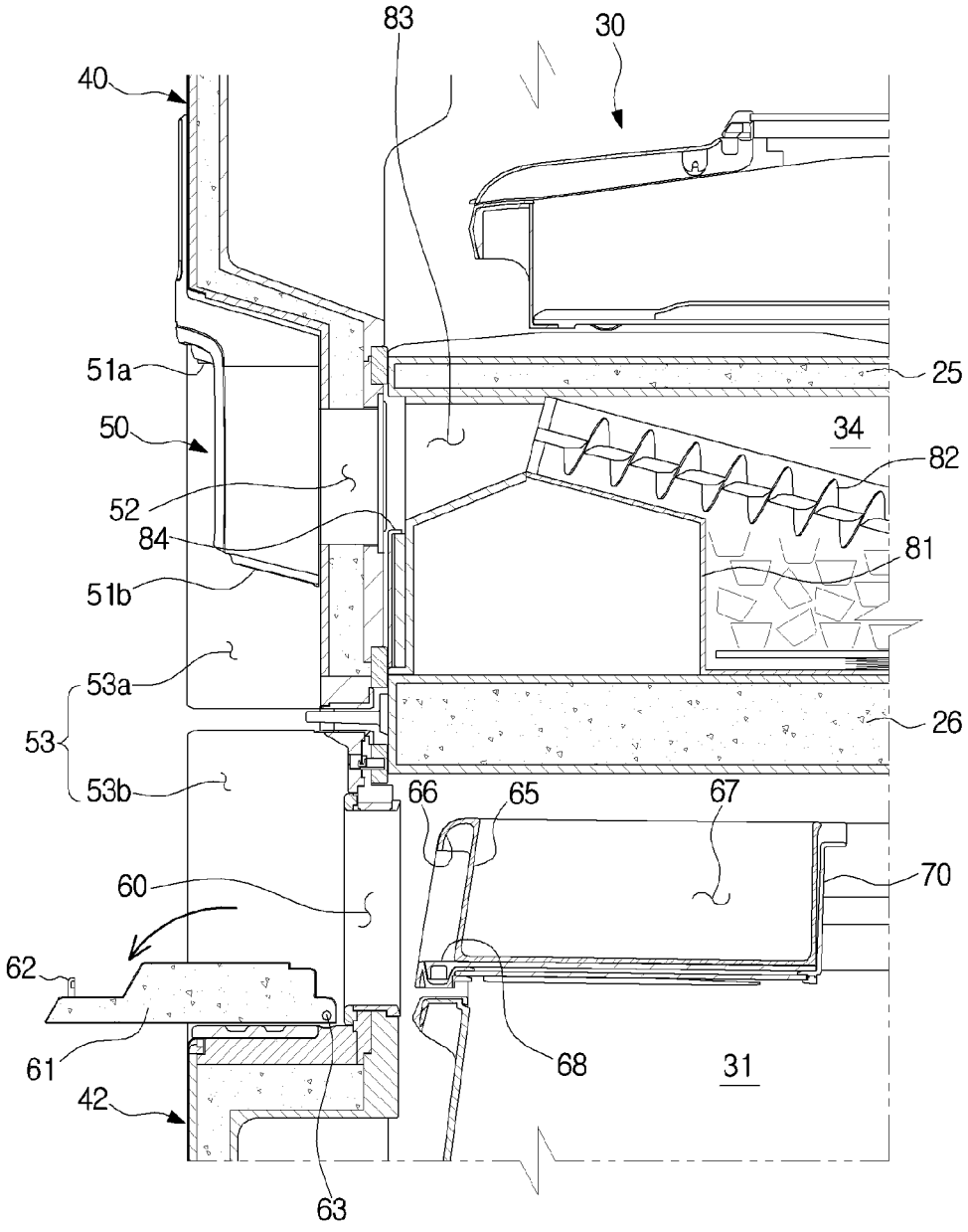
FIG. 10 illustrates a side cross sectional view of a state in which an ice home bar door of the refrigerator of FIG. 1 is opened according to various embodiments of the present disclosure.
Figure 11:
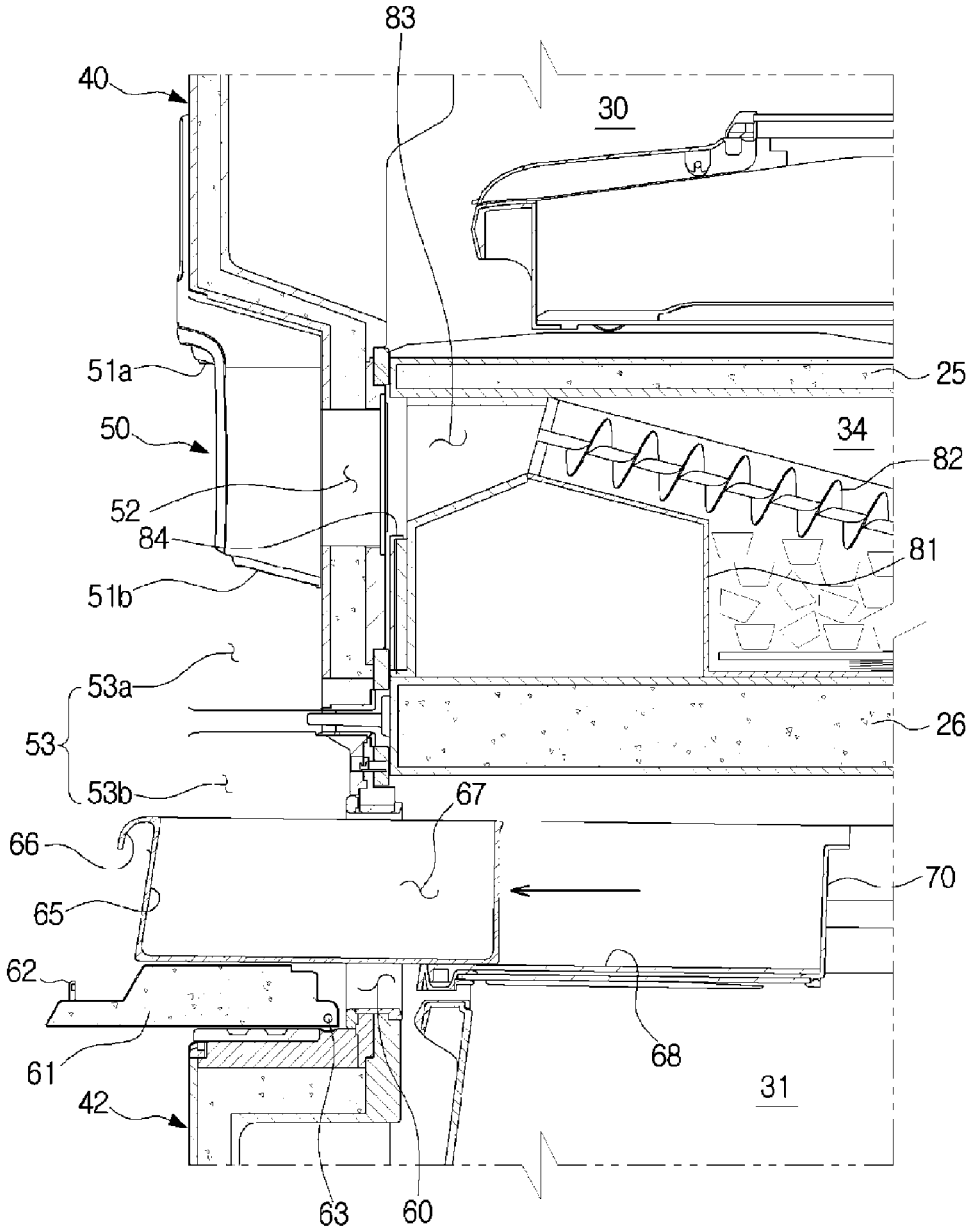
FIG. 11 illustrates a side cross sectional view of a state in which an ice home bar storage is withdrawn when the ice home bar door of the refrigerator of FIG. 1 is opened according to various embodiments of the present disclosure.
Figure 12:
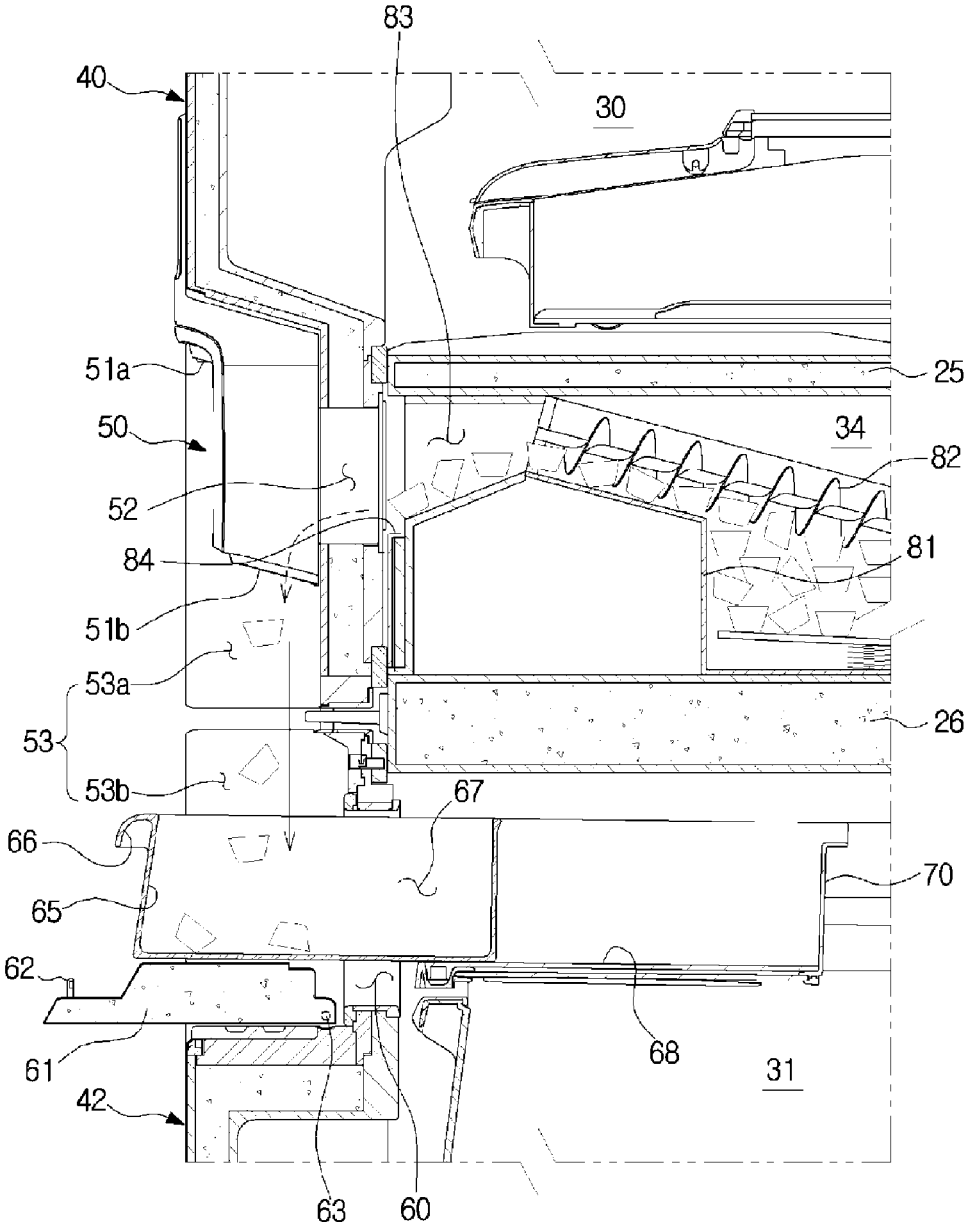
FIG. 12 illustrates a side cross sectional view of an operation in which ice discharged from a dispenser of the refrigerator of FIG. 1 is stored in the ice home bar storage according to various embodiments of the present disclosure.
Figure 13:
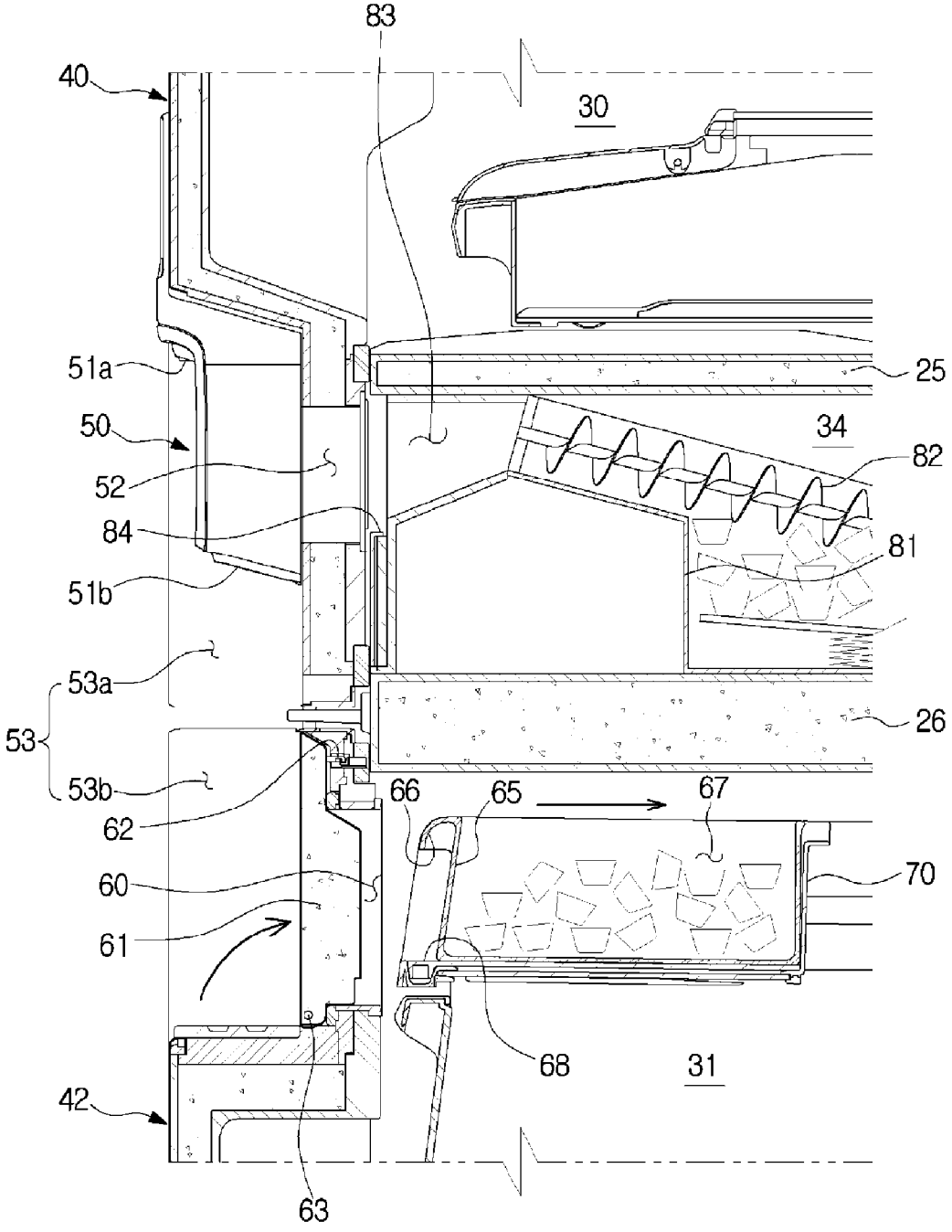
FIG. 13 illustrates a side cross sectional view of a state in which the ice home bar storage of the refrigerator of FIG. 1 is inserted into the inside of the first freezer compartment and the ice home bar door is closed according to various embodiments of the present disclosure.

FIG. 10 illustrates a side cross sectional view of a state in which an ice home bar door of the refrigerator of FIG. 1 is opened. FIG. 11 illustrates a side cross sectional view illustrating a state in which an ice home bar storage is withdrawn when the ice home bar door of the refrigerator of FIG. 1 is opened. FIG. 12 illustrates a side cross sectional view of an operation in which ice discharged from a dispenser of the refrigerator of FIG. 1 is stored in the ice home bar storage. FIG. 13 illustrates a side cross sectional view of a state in which the ice home bar storage of the refrigerator of FIG. 1 is inserted into the inside of the first freezer compartment and the ice home bar door is closed.

According to certain embodiments, an operation of the ice home bar door and the ice home bar storage will be described with reference to FIGS. 10 to 13.

As illustrated in FIG. 10, when a user wants to store ice in the ice home bar storage 65, the user may open the ice home bar door 61.

The ice home bar door 61 may be rotatable with respect to a rotational axis 63 in a lower end, and the ice home bar door 61 may be usually maintained to be locked by a hook member 62. The ice home bar door 61 may be configured to be opened in a push-to-open method in which a locking is released by pressing with a certain force.

As illustrated in FIG. 11, when the ice home bar door 61 is opened, the ice home bar storage 65 may be withdrawn via the ice home bar opening 60. The ice home bar storage 65 may be manually withdrawn by the handle 66 formed in the front surface of the ice home bar storage 65. When the ice home bar storage 65 is withdrawn, a rear surface of the ice home bar door 61 may support a bottom of the ice home bar storage 65.

As illustrated in FIG. 12, ice may be discharged by operating the dispenser 50 in a state in which the ice home bar storage 65 is withdrawn. The ice discharged from the ice outlet 51*b* may perform free fall and then be placed in an ice storage 67 of the ice home bar storage 65.

As illustrated in FIG. 13, after the ice is stored in the ice home bar storage 65, the user may insert the ice home bar storage 65 into the inside of the first freezer compartment 31, again and close the ice home bar door 61. The ice stored in the ice home bar storage 65 may be stored inside of the first freezer compartment 31 in a frozen state.

When a user needs ice, the user may take ice stored in the ice home bar storage 65 by opening the ice home bar door 61 without opening the lower door 42 and thus maintaining a temperature of the first freezer compartment 31 may be allowed.

Figure 14:
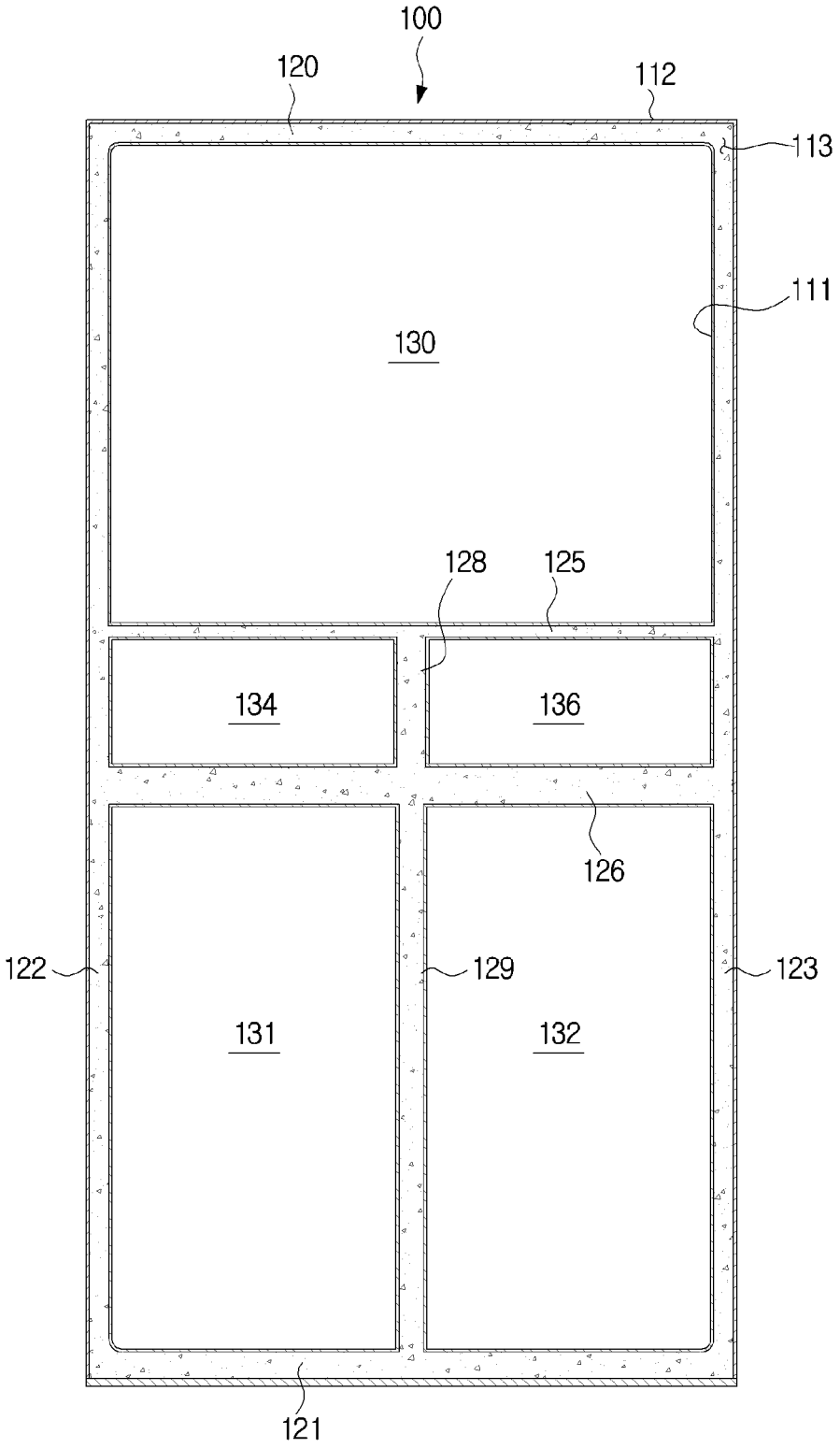
FIG. 14 illustrates a schematic, front cross sectional view of a body of a refrigerator in accordance with various embodiments of the present disclosure.

FIG. 14 illustrates a schematic, front cross sectional view of a body of a refrigerator in accordance with another embodiment.

Another embodiment of the present disclosure will be described with reference to FIG. 14. A description of the same parts as the above mentioned embodiment will be omitted.

According to certain embodiments, an ice making compartment and a second freezer compartment may be integrally formed without being divided.

A body 100 of a refrigerator may include an inner case 111, an outer case 112, and an insulation 113 formed between the inner case 111 and the outer case 112. In other words, the body 100 may include an upper wall 120, a lower wall 121, a left wall 122, a right wall 123, a first division wall 125, a second division wall 126, a middle wall 128 and 129.

An upper compartment 130 may be formed between the upper wall 120 and the first division wall 125, a center compartment 134 and 136 may be formed between the first division wall 125 and the second division wall 126, and a lower compartment 131 and 132 may be formed between the second division wall 126 and the lower wall 121.

The upper compartment 130 may include a fresh food compartment 130. The lower compartment 131 and 132 may include a first freezer compartment 131 and a first temperature convertible compartment 132. The first freezer compartment 131 and the first temperature convertible compartment 132 may be divided by the middle wall 129. The center compartment 134 and 136 may include an ice making compartment 134 and a second temperature convertible compartment 136. The ice making compartment 134 and the second temperature convertible compartment 136 may be divided by the middle wall 128. In the ice making compartment 134, an ice maker and food kept at a frozen state may be stored.

As is apparent from the above description, according to the proposed BMF type refrigerator, since the ice making compartment is provided between the fresh food compartment and the freezer compartment, the space utilization of the fresh food compartment may be enhanced. In addition, a length of the ice guide passage provided in the door may be reduced and thus a space in which food is stored may be increased.

According to the proposed BMF type refrigerator, since the auxiliary freezer compartment is provided between the fresh food compartment and the freezer compartment and configured to be opened and closed by the upper door, food may be separately stored in the freezer compartment and the auxiliary freezer compartment according to the type thereof, particularly a food that is needed to be inserted and withdrawn by a large number of times or food having a small size may be stored in the auxiliary freezer compartment.

Further, since the ice home bar storage to store ice dispensed from the dispenser is provided as well as the ice bucket to store ice discharged from the ice maker, the ice storage capacity may be increased.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a body;

a fresh food compartment provided in an upper portion of the body;

a first freezer compartment provided in a lower portion of the body;

a center compartment provided between the fresh food compartment and the first freezer compartment and provided with an ice making compartment;

an upper door configured to open and close the fresh food compartment and the ice making compartment of the center compartment at a same time;

a lower door configured to open and close the first freezer compartment, and a dispenser comprising a dispensing space configured to provide water stored in the fresh food compartment or ice generated in the ice making compartment, wherein the dispensing space comprises a first dispensing space recessed in a lower end of a front surface of the upper door and a second dispensing space recessed in an upper end of a front surface of the lower door.

2. The refrigerator of claim 1, wherein the body comprises an upper wall, a lower wall, a left wall, a right wall and a first division wall extended from the left wall of the body to the right wall of the body to divide the fresh food compartment and the center compartment.

3. The refrigerator of claim 2, wherein the first division wall is integrally formed with the upper wall, the lower wall, the left wall and the right wall.

4. The refrigerator of claim 1, wherein the body comprises an upper wall, a lower wall, a left wall, a right wall and a second division wall extended from the left wall of the body to the right wall of the body to divide the center compartment and the first freezer compartment.

5. The refrigerator of claim 4, wherein the second division wall is integrally formed with the upper wall, the lower wall, the left wall and the right wall.

6. The refrigerator of claim 1, wherein the ice making compartment and a second freezer compartment are divided from each other.

7. The refrigerator of claim 1, wherein the body comprises a middle wall configured to divide the ice making compartment and a second freezer compartment.

8. The refrigerator of claim 1, wherein the ice making compartment and a second freezer compartment are disposed side by side in a left and right direction.

9. The refrigerator of claim 1, wherein a second freezer compartment and the ice making compartment are not divided from each other.

10. The refrigerator of claim 1, wherein the center compartment further comprises a temperature convertible compartment configured to adjust a temperature thereof between a refrigerating temperature and a freezing temperature.

11. The refrigerator of claim 1, further comprising:

a seal configured to prevent air from flowing between the fresh food compartment and the center compartment when the upper door is closed.

12. The refrigerator of claim 1, wherein the dispenser further comprises:

an outlet to discharge water stored in the fresh food compartment or ice generated in the ice making compartment, and a container supporter configured to support a container receiving water or ice discharged from the outlet, wherein the outlet is provided in the upper door and the container supporter is provided in the lower door.

13. The refrigerator of claim 1, wherein the second dispensing space comprises an ice home bar door configured to allow a user to access to the first freezer compartment without opening the lower door.

14. The refrigerator of claim 13, further comprising:

an ice home bar storage configured to:

insert into and withdraw from the first freezer compartment when the ice home bar door is opened, and receive ice discharged from the dispenser when being withdrawn from the first freezer compartment.

* * * * *